US011506354B2

(12) United States Patent
Sato

(10) Patent No.: US 11,506,354 B2
(45) Date of Patent: Nov. 22, 2022

(54) VEHICLE LAMP

(71) Applicant: STANLEY ELECTRIC CO., LTD., Tokyo (JP)

(72) Inventor: Koji Sato, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/525,667

(22) Filed: Nov. 12, 2021

(65) Prior Publication Data

US 2022/0163179 A1 May 26, 2022

(30) Foreign Application Priority Data

Nov. 20, 2020 (JP) ..... JP2020-193422

(51) Int. Cl.
*F21S 41/24* (2018.01)
*F21S 41/20* (2018.01)
*F21S 41/147* (2018.01)

(52) U.S. Cl.
CPC ..... *F21S 41/24* (2018.01); *F21S 41/147* (2018.01); *F21S 41/285* (2018.01)

(58) Field of Classification Search
CPC ..... F21S 41/336; F21S 41/333; F21S 41/33; F21S 41/322; F21S 41/24; F21S 41/285; G02B 6/4298; G02B 6/0006; G02B 6/0021
See application file for complete search history.

(56) References Cited

U.S. PATENT DOCUMENTS 5,404,869 A * 4/1995 Parkyn, Jr. ..... G02B 27/09 136/246
7,374,322 B2 * 5/2008 Steen ..... B60Q 1/263 362/546
8,109,664 B2 * 2/2012 Nakada ..... F21S 43/14 362/555
10,608,151 B2 * 3/2020 Aruga ..... F21S 43/14
2012/0155103 A1 * 6/2012 Okada ..... F21S 43/40 362/518

FOREIGN PATENT DOCUMENTS

JP 2011-222339 A 11/2011
JP 2015-213025 A 11/2015

* cited by examiner

*Primary Examiner* — Matthew J. Peerce
(74) *Attorney, Agent, or Firm* — Kenealy Vaidya LLP

(57) ABSTRACT

A vehicle lamp includes a light emitting unit having a light source and a light guide lens, the light guide lens has an incidence section from which light emitted from the light source enters inside of the light guide lens, and an emission section from which the light entered inside of the light guide lens from the incidence section is emitted to an outside, the incidence section has a plurality of stepped portions which are radially arranged about an optical axis of a light emitted from the light source and which are inclined toward an advancing direction of the light, and the stepped portions have a form in which incidence surfaces, from which a light radially emitted from the light source enters inside of the light guide lens while parallelizing the entered light, and connecting surfaces, which are adjacent to the incidence surfaces, are alternately arranged in a radial direction.

8 Claims, 4 Drawing Sheets

VEHICLE LAMP

CROSS-REFERENCE TO RELATED APPLICATION

Priority is claimed on Japanese Patent Application No. 2020-193422, filed Nov. 20, 2020, the content of which is incorporated herein by reference.

BACKGROUND OF THE INVENTION

Field of the Invention

The present invention relates to a vehicle lamp.

Description of Related Art

In the related art, as a vehicle lamp mounted on a vehicle, a combination of a light source such as a light emitting diode (LED) or the like and a light guide lens such as an inner lens or the like is known (for example, see Japanese Unexamined Patent Application, First Publication No. 2011-222339 and Japanese Unexamined Patent Application, First Publication No. 2015-213025).

However, while an LED has high directivity (straightness), it also has the characteristic that light is difficult to diffuse therefrom. For this reason, in a vehicle lamp, so-called brightness (light emission) non-uniformity in which a portion in the vicinity of the optical axis at a center of a front surface of the LED among an emission surface (a light emitting surface) of the light guide lens emits light more strongly than other portions is likely to occur.

In addition, among light guide lenses, there is a light guide lens that has a laterally elongated emission surface (light emitting surface) in which a dimension in one direction (for example, a longitudinal direction) perpendicular to an optical axis of light emitted from a light source is shorter than a dimension in other directions (for example, a lateral direction) perpendicular to the optical axis and the one direction.

In this case, among the light emitted radially from the light source, light within an angle range that is relatively narrow in the longitudinal direction enters the light guide lens, and light within an angle range that is relatively wide in the lateral direction enters the light guide lens. Accordingly, in the emission surface (the light emitting surface) of the light guide lens, since light is emitted more strongly in the longitudinal direction than in the lateral direction, a brightness difference between the longitudinal direction and the lateral direction increases as an aspect ratio increases (it becomes laterally elongated), and thus, the appearance upon lighting up deteriorates.

SUMMARY OF THE INVENTION

An aspect of the present invention is directed to providing a vehicle lamp capable of light emission with good appearance.

The present invention provides the following configurations.

(1) A vehicle lamp including:

a light emitting unit having a light source and a light guide lens, wherein the light guide lens has an incidence section from which a light emitted from the light source enters inside of the light guide lens, and an emission section from which the light entered inside of the light guide lens from the incidence section is emitted to an outside, wherein the incidence section has a plurality of stepped portions which are radially arranged about an optical axis of a light emitted from the light source and which are inclined toward an advancing direction of the light, and wherein the stepped portions have a form in which incidence surfaces, from which a light radially emitted from the light source enters inside of the light guide lens while parallelizing the entered light, and connecting surfaces, which are adjacent to the incidence surfaces, are alternately arranged in a radial direction.

(2) The vehicle lamp according to the above-mentioned (1), wherein the light guide lens has a shape in which a dimension perpendicular to the optical axis in one direction is smaller than a dimension perpendicular to the optical axis and the one direction in the other direction, and is disposed in a state in which a central axis of the light guide lens coincides with the optical axis.

(3) The vehicle lamp according to the above-mentioned (2), wherein, as rotating from the one direction to the other direction, the plurality of stepped portions have a form in which arranged intervals of the incidence surfaces and the connecting surfaces in each of the stepped portions gradually increase.

(4) The vehicle lamp according to the above-mentioned (2) or (3), wherein, among the light radially emitted from the light source, an angle with respect to the optical axis of a light which enters an end portion of the incidence surface farthest from the optical axis in the one direction and an angle with respect to the optical axis of a light which enters an end portion of the incidence surface farthest from the optical axis in the other direction substantially coincides with each other.

(5) The vehicle lamp according to any one of the above-mentioned (2) to (4), wherein the incidence section has a pair of incidence surfaces, on which the light radially emitted from the light source enters inside of the light guide lens while being parallelized, at both sides in the one direction with the optical axis being interposed between the pair of incidence surfaces.

(6) The vehicle lamp according to any one of the above-mentioned (1) to (5), wherein the stepped portions have a shape in which lengths of the incidence surfaces in the radial direction gradually increase as they are separated from the optical axis.

(7) The vehicle lamp according to any one of the above-mentioned (1) to (6), wherein the incidence surface is constituted by a curved surface.

(8) The vehicle lamp according to any one of the above-mentioned (1) to (7), wherein the connecting surface is inclined at an angle smaller than an angle with respect to the optical axis of a light which enters an incidence surface which is neighboring of the connecting surface at a side separating from the optical axis.

(9) The vehicle lamp according to any one of the above-mentioned (1) to (8), wherein the plurality of light emitting units are provided in a state in which the plurality of light emitting units are aligned next to each other.

(10) The vehicle lamp according to the above-mentioned (9) wherein the light emitting units are formed so that the light guide lenses of the plurality of light emitting units aligned next to each other are integrally formed with each other.

According to the aspect of the present invention, it is possible to provide a vehicle lamp capable of light emission with good appearance.

DETAILED DESCRIPTION OF THE INVENTION

Figure 1:
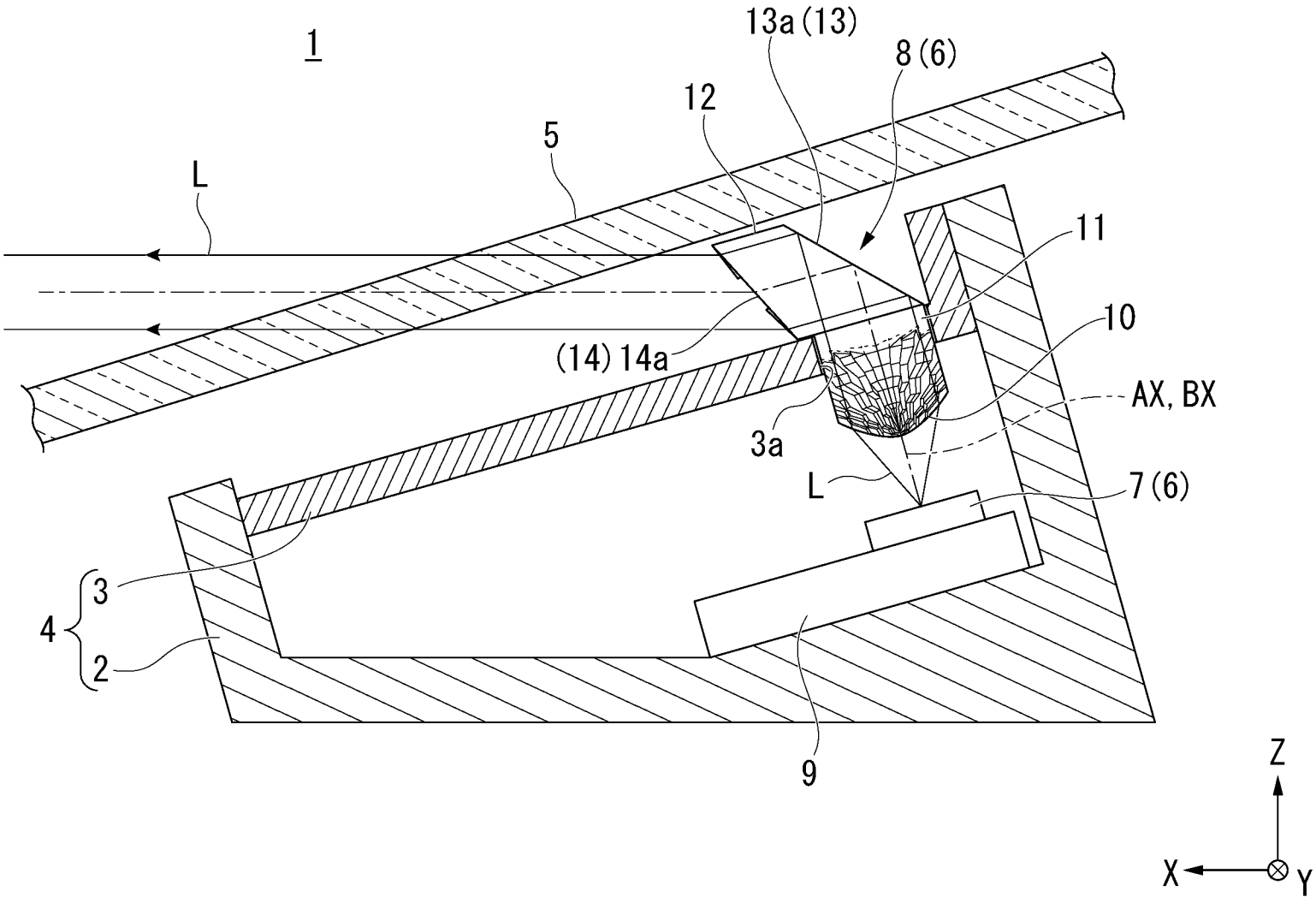
FIG. 1 is a cross sectional view showing a configuration of a vehicle lamp according to an embodiment of the present invention.

Hereinafter, an embodiment of the present invention will be described in detail with reference to the accompanying drawings.

Further, in the drawings used in the following description, in order to make each of components easier to see, the dimensional scale may be different depending on the component, and the dimensional ratios or the like of each of components may not always be the same as the actual ones.

Figure 2:
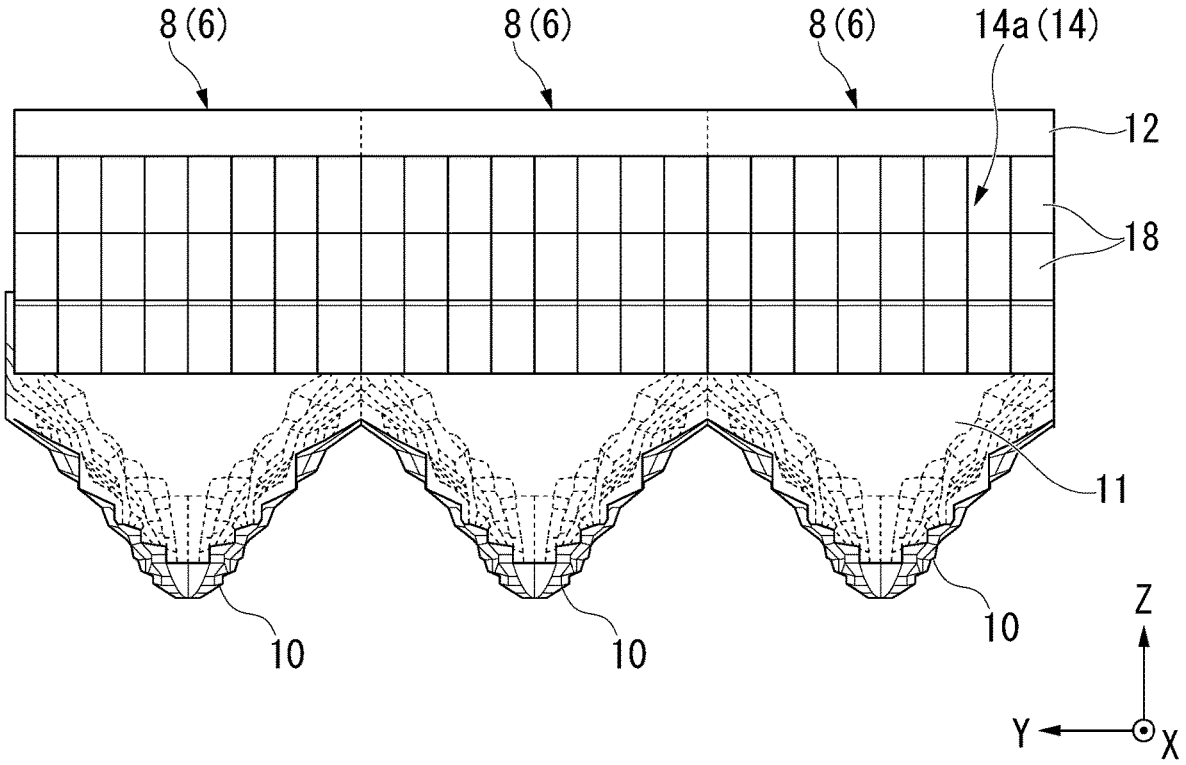
FIG. 2 is a front view showing a configuration of a light guide lens.
Figure 3:
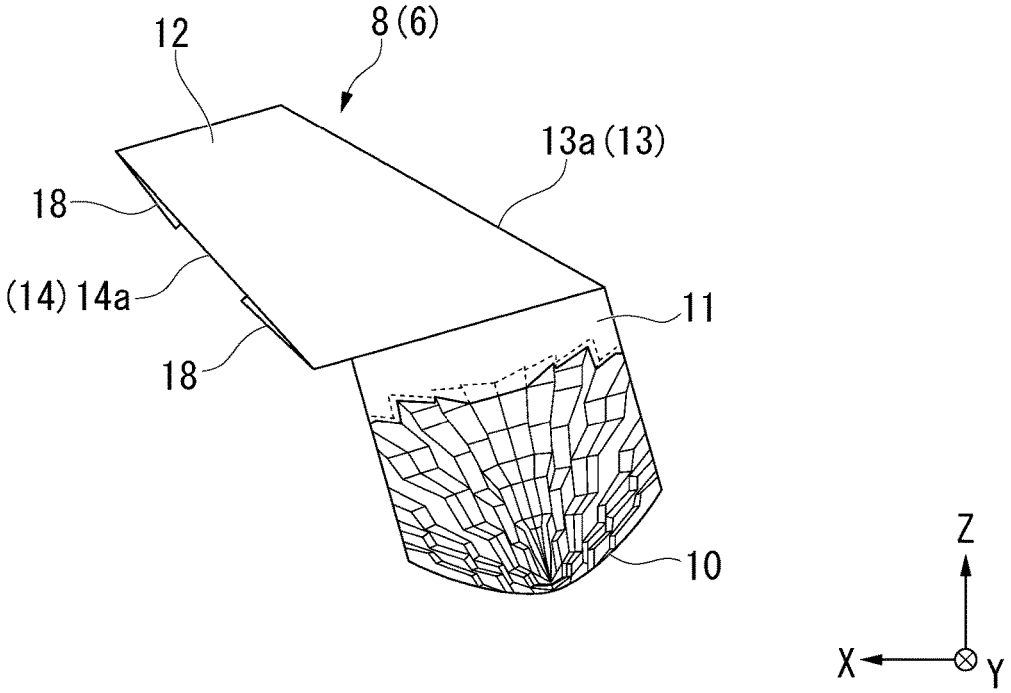
FIG. 3 is a side view showing the configuration of the light guide lens.
Figure 4:
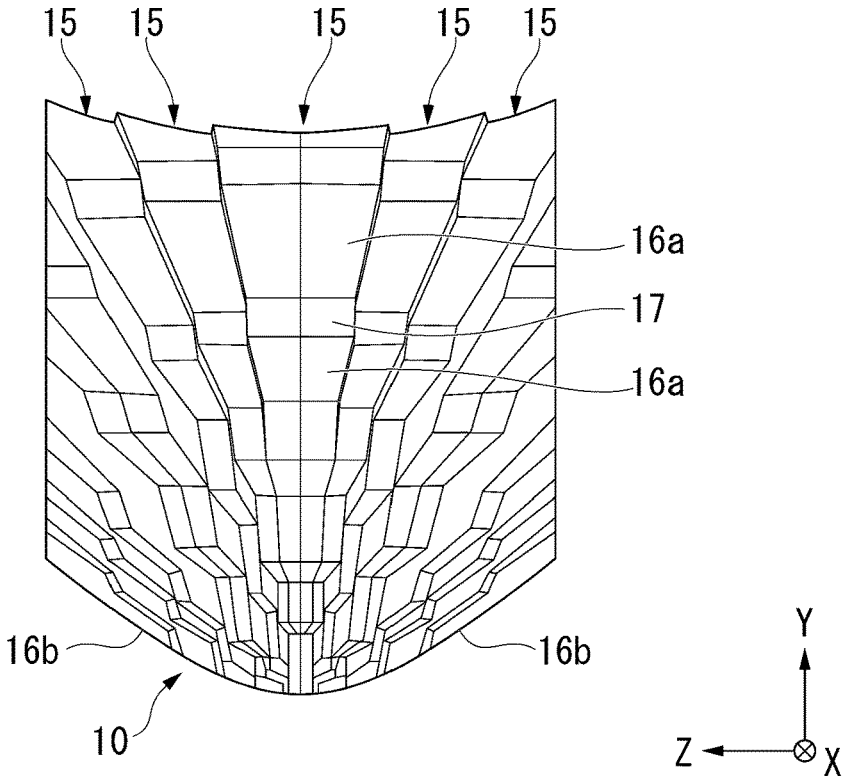
FIG. 4 is a perspective view showing a configuration of an incidence section.
Figure 5:
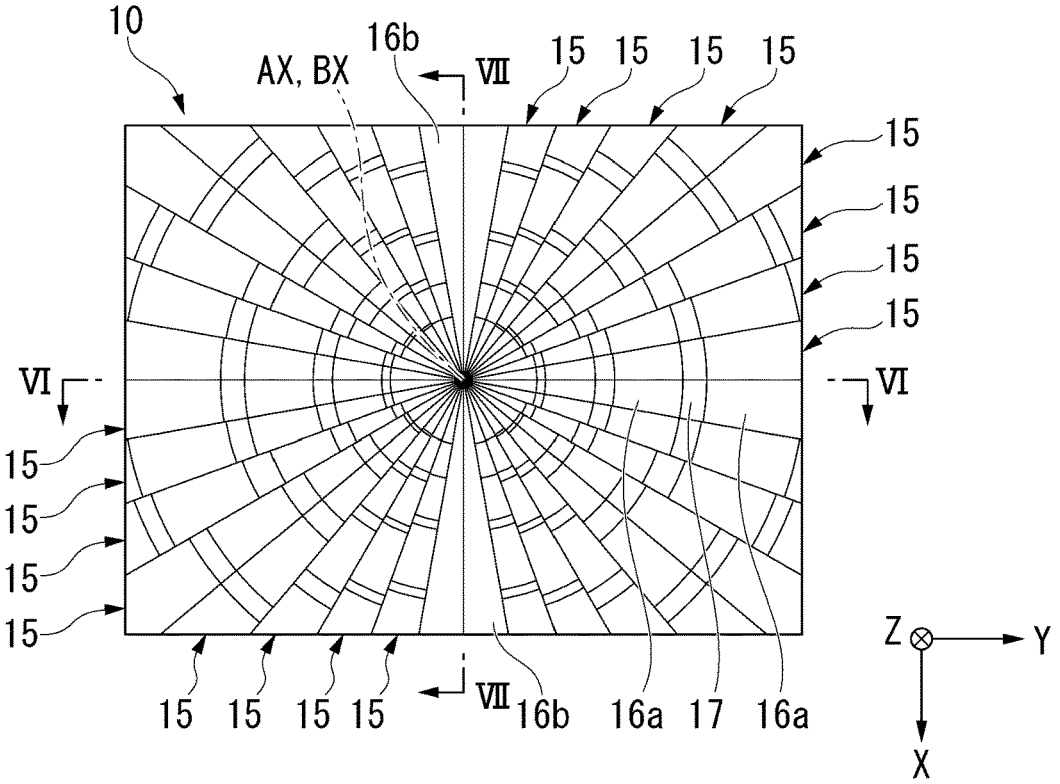
FIG. 5 is a front view showing the configuration of the incidence section.
Figure 6:
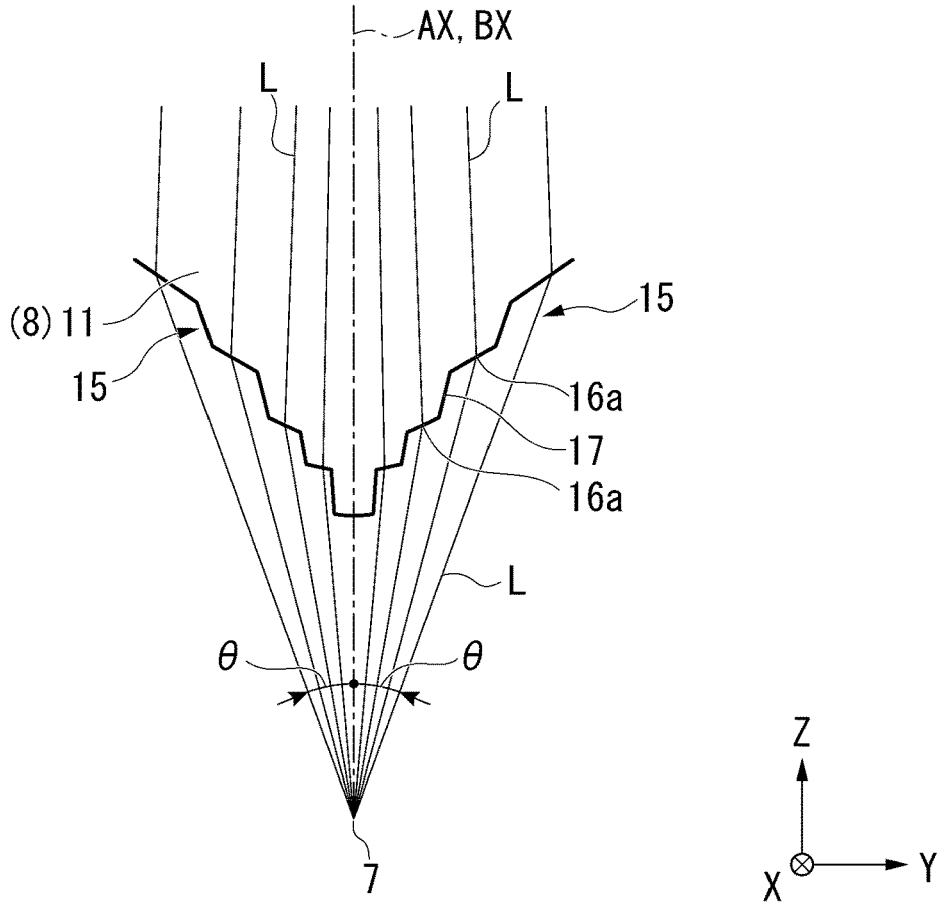
FIG. 6 is a cross sectional view showing an optical path of light incident in the incidence section, in a lateral cross-sectional view of the incidence section along line segment VI-VI shown in FIG. 5.
Figure 7:
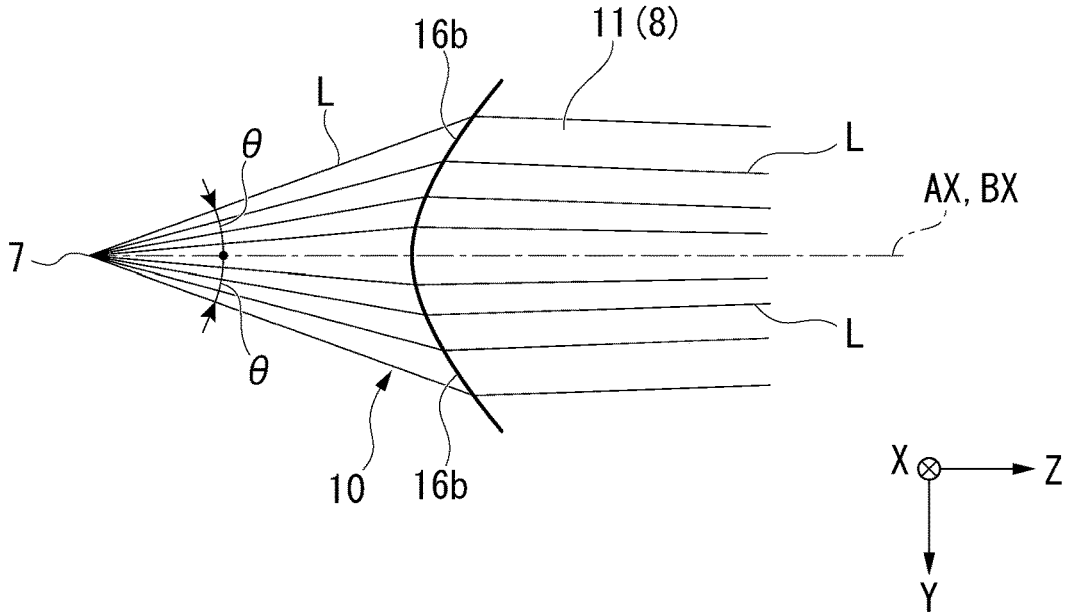
FIG. 7 is a cross sectional view showing an optical path of light incident in the incidence section, in a longitudinal cross-sectional view of the incidence section along line segment VII-VII shown in FIG. 5.

As an embodiment of the present invention, for example, a vehicle lamp 1 shown in FIG. 1 to FIG. 7 will be described. Further, FIG. 1 is a cross sectional view showing a configuration of the vehicle lamp 1. FIG. 2 is a front view showing a configuration of a light guide lens. FIG. 3 is a side view showing the configuration of the light guide lens. FIG. 4 is a perspective view showing a configuration of an incidence section. FIG. 5 is a front view showing the configuration of the incidence section. FIG. 6 is a cross sectional view showing an optical path of light incident in the incidence section, in a lateral cross-sectional view of the incidence section along a line segment VI-VI shown in FIG. 5. FIG. 7 is a cross sectional view showing an optical path of light incident in the incidence section, in a longitudinal cross-sectional view of the incidence section along a line segment VII-VII shown in FIG. 5.

In addition, in the drawings described below, an XYZ orthogonal coordinates system is set, an X-axis direction indicates a forward/rearward direction (a lengthwise direction) in the vehicle lamp 1, a Y-axis direction indicates a leftward/rightward direction (a widthwise direction) of the vehicle lamp 1, and a Z-axis direction indicates an upward/downward direction (a height direction) of the vehicle lamp 1.

The vehicle lamp 1 of the embodiment is obtained by, for example, applying the present invention to a high mount stop lamp mounted on a central portion of a rear end side of a vehicle (not shown).

Further, directions of forward, rearward, leftward, rightward, upward and downward in the following description are the same as directions in the vehicle lamp 1 when looking towards a front surface thereof (from behind of the vehicle) unless the context clearly indicates otherwise. Accordingly, directions in forward, rearward, leftward and rightward are inverted compared to the directions when looking towards a front surface of the vehicle (a front side of the vehicle).

Specifically, as shown in FIG. 1, the vehicle lamp 1 includes a lighting body 4 constituted by a housing 2 having a front surface that is open and a cover 3 configured to cover an opening of the housing 2, and is disposed in a state in which the lighting body 4 is facing an inner surface of a rear glass 5 of a vehicle. Further, a shape of the lighting body 4 can be appropriately changed according to a design or the like of the vehicle.

The vehicle lamp 1 includes a plurality of (three in the embodiment) light emitting units 6. The plurality of light emitting units 6 have a structure in which they are integrated and arranged next to each other in a widthwise direction of the lighting body 4.

Each of the light emitting units 6 has a light source 7 and a light guide lens 8. Accordingly, the vehicle lamp 1 of the embodiment includes a plurality of light sources 7 corresponding to the plurality of light emitting units 6, and a plurality of light guide lenses 8 corresponding to the plurality of light emitting units 6. In addition, the plurality of light guide lenses 8 are integrally formed and arranged next to each other in the widthwise direction of the lighting body 4.

The light source 7 is constituted by light emitting diodes (LEDs) configured to emit red light (hereinafter, simply referred to as "light") L. The plurality of light sources 7 are mounted on one surface of a circuit board 9 on which a driving circuit configured to drive the LEDs is provided (an upper surface in the embodiment) while being arranged next to each other at equal intervals in the widthwise direction. Accordingly, the light source 7 radially emits the light L toward the light guide lens 8 on an upper side while being disposed inside the lighting body 4 together with the circuit board 9.

Further, since the circuit board 9 has a configuration in which a driving circuit configured to drive the above-mentioned LEDs is provided, a mounting board on which the LEDs are provided and a circuit board on which the driving circuit is provided are disposed separately, and the mounting board and the circuit board are electrically connected via a wiring cord, which is referred to as a harness, the driving circuit may thus be protected from heat emitted from the LEDs.

Further, in the embodiment, the light guide lens 8 is disposed to be inclined forward. According to this, the light source 7 is disposed such that an optical axis AX of the light L emitted from the light source 7 is inclined forward.

As shown in FIG. 1, FIG. 2 and FIG. 3, the light guide lens 8 is constituted by a light transmissive member configured to guide the light L emitted from the light source 7. The light transmissive member may be formed of a material having a higher refractive index than air, for example, a transparent resin such as polycarbonate, acryl, or the like, glass, or the like.

The light guide lens 8 has an incidence section 10 into which the light L emitted from the light source 7 is incident, a first light guide section 11 and a second light guide section 12 configured to guide the light L incident from the incidence section 10, a reflection section 13 disposed between the first light guide section 11 and the second light guide section 12 and configured to reflect the light L guided inside the first light guide section 11 toward the second light guide section 12, and an emission section 14 configured to emit the light L guided into the second light guide section 12 toward the outside (forward).

The first light guide section 11 constitutes a portion between the incidence section 10 disposed on a lower end side of the first light guide section 11 and the reflection section 13 disposed on an upper end side of the first light guide section 11 configured to guide the light L upward. The second light guide section 12 constitutes a portion between the reflection section 13 disposed on a rear end side of the second light guide section 12 and the emission section 14 disposed on a front end side of the second light guide section 12 configured to guide the light L forward.

In addition, among the light guide lens 8, the first light guide section 11 is disposed inside an opening section 3*a* provided on the cover 3, and the second light guide section 12 is exposed to the outside of the lighting body 4.

The light guide lens 8 has a laterally elongated shape in which a dimension in one direction perpendicular to the optical axis AX of the light L emitted from the light source 7 (in the embodiment, a longitudinal direction) is smaller than a dimension in the other direction perpendicular to the optical axis AX and the one direction (in the embodiment, a lateral direction). In addition, the light guide lens 8 is disposed in a state in which a central axis BX coincides with the optical axis AX.

In the embodiment, a case in which an aspect ratio (length:width) of the light guide lens 8 is 3:4 is exemplified. Further, the aspect ratio (length:width) of the light guide lens 8 can be laterally elongated to about 1:2.

As shown in FIG. 4 and FIG. 5, the incidence section 10 has a laterally elongated rectangular shape when seen in a front view, and includes a plurality of stepped portions 15 radially arranged about the optical axis AX of the light L emitted from the light source 7 and inclined toward an advancing direction of the light L.

The stepped portions 15 has a stepped form in which incidence surfaces 16*a* configured to cause the light L radially emitted from the light source 7 to enter inside the first light guide section 11 (the light guide lens 8) while parallelizing (collimating) the light L, and connecting surfaces 17 adjacent to the incidence surfaces 16*a*, are alternately arranged in a radial direction (a direction perpendicular to the optical axis AX).

As rotating from a longitudinal direction (one direction) to a lateral direction (the other direction), the plurality of stepped portions 15 have a form in which arranged intervals of the incidence surfaces 16*a* and the connecting surfaces 17 in each of the stepped portions 15 gradually increase. In addition, each of the stepped portions 15 has a form in which a length of the incidence surface 16*a* in the radial direction gradually increases as it separates from the optical axis AX.

The incidence surface 16*a* is constituted by a curved surface that is controlled such that the light L incident on the incidence surface 16*a* becomes parallel to the optical axis AX.

Accordingly, in a cross section in the other direction shown in FIG. 6 (a lateral cross section), it is possible to make the light L radially emitted from the light source 7 efficiently enter inside of the first light guide section 11 (the light guide lens 8) while parallelizing (collimating) the light L radially emitted from the light source 7 by each of the incidence surfaces 16*a* at the stepped portions 15.

Meanwhile, the connecting surface 17 is constituted by inclined surface inclined at an angle smaller than an angle of the light L, which enters the incidence surface 16*a* which is neighboring of the connecting surface 17 at a side separating from the optical axis AX, with respect to the optical axis AX. Further, the connecting surface 17 is not limited to a flat surface and may be a curved surface.

Accordingly, in the stepped portion 15, it is made possible to make the light L radially emitted from the light source 7 not to incident on the connecting surface 17 and to make the light L radially emitted from the light source 7 appropriately enter the incidence surface 16*a* which is neighboring of the connecting surface 17 at a side separating from the optical axis AX.

In addition, the incidence section 10 has a pair of incidence surfaces 16*b* configured to cause the light L entering inside the first light guide section 11 (the light guide lens 8) while parallelizing (collimating) the light L radially emitted from the light source 7 at both sides in the longitudinal direction (one direction) with the optical axis AX being interposed between the pair of incidence surfaces 16*b*.

That is, in a cross section in one direction shown in FIG. 7 (a longitudinal cross section), the light L radially emitted from the light source 7 enters into the first light guide section 11 (the light guide lens 8) while parallelizing (collimating) the light L radially emitted from the light source 7 in the pair of incidence surfaces 16*b*.

In the incidence section 10, among the light L radially emitted from the light source 7, an angle of the light L entering an end portion of the incidence surface 16*b*, which is farthest from the optical axis AX in the longitudinal direction (one direction), with respect to the optical axis AX substantially coincides with an angle of the light L entering an end portion of the incidence surfaces 16*a*, which is farthest from the optical axis AX in the lateral direction (the other direction), with respect to the optical axis AX.

That is, the incidence section 10 is designed such that, among the light L radially emitted from the light source 7, the light L with the same angle range θ (for example, θ=30°) with respect to the optical axis AX is incident thereinto. The light L having the angle range θ of 30° with respect to the optical axis AX is light with small brightness non-uniformity that is relatively bright in the peripheral section of the optical axis AX (brightness is high) among the light L radially emitted from the light source 7.

In the incidence section 10, an optical path length from the light source 7 to each of the incidence surfaces 16*a* and 16*b* is adjusted such that the light L having the same angle range with respect to the optical axis AX is incident on each of the incidence surfaces 16*a* and 16*b* according to a difference in an aspect ratio of the incidence section 10.

Accordingly, it is possible to eliminate a brightness difference of the light L entering the incidence section 10 in the longitudinal direction and in the lateral direction due to the difference in aspect ratio of the incidence section 10 and cause more uniform light L to enter the incidence section 10.

In the incidence section 10, the light L emitted from the light source 7 enters the first light guide section 11 (the light guide lens 8) while parallelizing (collimating) the light L emitted from the light source 7. Accordingly, the light L entered the first light guide section 11 is guided toward the reflection section 13, which is disposed at an upper side, while being parallelized.

As shown in FIG. 1 and FIG. 3, the reflection section 13 has a reflection surface 13*a*. The reflection surface 13*a* is constituted by an inclined surface that is inclined forward at a predetermined angle (in the embodiment, 45°) with respect to the optical axis AX of the light L emitted from the light source.

Accordingly, in the reflection section 13, the light L guided inside the first light guide section 11 is reflected toward the second light guide section 12 on the front side by the reflection surface 13*a*. Accordingly, the light L entered inside the second light guide section 12 is guided toward the emission section 14 on the front side while in a parallelized state.

As shown in FIG. 1, FIG. 2 and FIG. 3, the emission section 14 has an emission surface 14*a*. The emission surface 14*a* has a laterally elongated rectangular shape when seen in a front view. In addition, when the plurality of light guide lenses 8 are aligned in the lateral direction (the other direction), the emission surfaces 14*a* of the light guide lenses 8 constitute the emission surface 14*a* continuous in the lateral direction (the other direction).

A plurality of diffusion cuts 18 for light distribution control are provided on the emission surface 14*a* to be aligned in the height direction (one direction) and the widthwise direction (the other direction). Each of the plurality of diffusion cuts 18 has a rectangular shape when seen in a front view and is constituted by a curved surface controlled to diffuse the light L emitted from the emission surface 14*a* in the widthwise direction (the other direction).

Further, the diffusion cut 18 is not particularly limited to the above-mentioned rectangular shape and the shape may be appropriately changed. In addition, the diffusion cut 18 is not limited to being diffused in the widthwise direction (the other direction) and an orientation thereof can also be controlled to be diffused in the height direction (one direction).

Accordingly, in the emission section 14, the light L guided into the second light guide section 12 is emitted from the emission surface 14*a* to the outside (forward) of the second light guide section 12 (the light guide lenses 8) while being diffused by the diffusion cuts 18 in the widthwise direction.

In the emission section 14, an optical path length of the light L guided from each of the incidence surfaces 16*a* and 16*b* to the emission surface 14*a* is adjusted according to the difference in an aspect ratio of the emission section 14. That is, the optical path length is increased as it is closer to the optical axis AX, and the optical path length is reduced as it is separated from the optical axis AX.

Accordingly, it is possible to eliminate a brightness difference of the light L emitted from the emission section 14 in the longitudinal direction and the lateral direction due to a difference in the aspect ratio of the emission section 14 and emit more uniform light L from the emission section 14. Accordingly, in the emission section 14, the emission surface 14*a* can emit light more uniformly as the light emitting surface of the light emitting unit 6.

As described above, in the vehicle lamp 1 of the embodiment, even when the aspect ratios of the above mentioned light guide lenses 8 are different, it is possible to emit light from the light emitting surfaces of the light emitting units 6 more uniformly corresponding to a difference in the aspect ratio of the light guide lenses 8, and appearance upon lighting can be improved.

Further, the present invention is not necessarily limited to the embodiment and various modifications may be made without departing from the scope of present invention.

For example, the above mentioned light guide lens 8 has a configuration in which the reflection section 13 disposed between the above mentioned incidence section 10 and the emission section 14 reflects the light L at between the first light guide section 11 and the second light guide section 12. However, such reflection section 13 may be omitted, and a configuration in which the light L entered from the incidence section 10 in a parallelized state is directly guided to the emission section 14 may be used.

In addition, in the above mentioned light guide lens 8, while the above mentioned incidence section 10 and the emission section 14 have a laterally elongated rectangular shape when seen in a front view, they may have a configuration that has an elliptical shape or an oval shape when seen in a front view.

Further, in the above mentioned embodiment, while the case in which the present invention is applied to a high mount stop lamp as the vehicle lamp has been exemplified, the vehicle lamp to which the present invention is applied is not limited to the above-mentioned high mount stop lamp, and for example, the present invention may be widely applied to a vehicle lamp such as a head light (a head lamp), a direction indicator (a turn lamp), a width indicator (a position lamp), a subsidiary head light (a subsidiary head lamp), a front (rear) fog light (fog lamp), a day running light (DRL), a lid lamp, a tail light (a tail lamp), a brake lamp (a stop lamp), a back lamp for a vehicle, or the like.

In addition, even in color of light emitted from the above mentioned light source 7, white light, red light, orange light, or the like, can also be appropriately changed according to a use thereof. In addition, the above mentioned light source 7 can use a light emitting element, for example, a laser diode (LD), or the like, in addition to the above-mentioned LED.

In addition, while the present invention is preferably used for the above-mentioned vehicle lamp, for example, it can also be applied to applications other than a vehicle lamp such as general lighting or the like.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A vehicle lamp comprising:

a light emitting unit having a light source and a light guide lens, wherein the light guide lens has an incidence section from which a light emitted from the light source enters inside of the light guide lens, and an emission section from which the light entered inside of the light guide lens from the incidence section is emitted to an outside, wherein the incidence section has a plurality of stepped portions which are radially arranged about an optical axis of a light emitted from the light source and which are inclined toward an advancing direction of the light, wherein the stepped portions have a form in which incidence surfaces, from which a light radially emitted from the light source enters inside of the light guide lens while parallelizing the entered light, and connecting surfaces, which are adjacent to the incidence surfaces, are alternately arranged in a radial direction, wherein the light guide lens has a shape in which a dimension perpendicular to the optical axis in one direction is smaller than a dimension perpendicular to the optical axis and the one direction in the other direction, and is disposed in a state in which a central axis of the light guide lens coincides with the optical axis, wherein, as rotating from the one direction to the other direction, the plurality of stepped portions have a form in which arranged intervals of the incidence surfaces and the connecting surfaces in each of the stepped portions gradually increase.

2. The vehicle lamp according to claim 1, wherein, among the light radially emitted from the light source, an angle with respect to the optical axis of a light which enters an end portion of the incidence surface farthest from the optical axis in the one direction and an angle with respect to the optical axis of a light which enters an end portion of the incidence surface farthest from the optical axis in the other direction substantially coincides with each other.

3. The vehicle lamp according to claim 1, wherein the incidence section has a pair of incidence surfaces, on which the light radially emitted from the light source enters inside of the light guide lens while being parallelized, at both sides in the one direction with the optical axis being interposed between the pair of incidence surfaces.

4. The vehicle lamp according to claim 1, wherein the stepped portions have a shape in which lengths of the incidence surfaces in the radial direction gradually increase as they are separated from the optical axis.

5. The vehicle lamp according to claim 1, wherein the incidence surface is constituted by a curved surface.

6. The vehicle lamp according to claim 1, wherein the connecting surface is inclined at an angle smaller than an angle with respect to the optical axis of a light which enters an incidence surface which is neighboring of the connecting surface at a side separating from the optical axis.

7. The vehicle lamp according to claim 1, wherein the plurality of light emitting units are provided in a state in which the plurality of light emitting units are aligned next to each other.

8. The vehicle lamp according to claim 7, wherein the light emitting units are formed so that the light guide lenses of the plurality of light emitting units aligned next to each other are integrally formed with each other.

* * * * *